United States Patent [19]

Arai

[11] Patent Number: 4,878,092

[45] Date of Patent: Oct. 31, 1989

[54] METHOD OF CONTROLLING A FIXING UNIT OF AN IMAGE FORMING APPARATUS

[75] Inventor: Atsushi Arai, Ichikawa, Japan

[73] Assignee: Ricoh Company, Ltd., Tokyo, Japan

[21] Appl. No.: 199,870

[22] Filed: May 27, 1988

[30] Foreign Application Priority Data

May 29, 1987 [JP] Japan ..... 62-83622[U]

[51] Int. Cl.[4] ..... G03G 15/20

[52] U.S. Cl. ..... 355/285; 219/216

[58] Field of Search ..... 355/14 FU, 3 FU, 3 R; 219/216

[56] References Cited

U.S. PATENT DOCUMENTS

| | | | |
|---|---|---|---|
| 3,926,519 | 12/1975 | Rebres | 355/14 FU |
| 3,989,370 | 11/1976 | Mooney | 355/14 FU |
| 4,161,644 | 7/1979 | Yanagawa | 355/14 FU |
| 4,618,245 | 10/1986 | Fukushi et al. | 355/14 FU |
| 4,671,643 | 6/1987 | Shigemura et al. | 355/14 FU |

*Primary Examiner*—Moses R. L.

*Attorney, Agent, or Firm*—Oblon, Spivak, McClelland, Maier & Neustadt

[57] ABSTRACT

A method of controlling a fixing unit which is installed in an electrophotographic copier, facsimile apparatus or like image forming apparatus and includes a fixing roller and a pressing roller. A secure fixing temperature of the fixing unit is selectively set to at least two different temperatures.

6 Claims, 8 Drawing Sheets

METHOD OF CONTROLLING A FIXING UNIT OF AN IMAGE FORMING APPARATUS

BACKGROUND OF THE INVENTION

The present invention relates to a method of controlling a fixing unit which is installed in an image forming apparatus and constituted by a fixing roller and a pressing roller.

An electrophotographic copier, facsimile apparatus or like image forming apparatus usually includes a fixing unit which includes a fixing roller and a pressing roller. It is a common practice to control the fixing temperature of the fixing roller to a secure fixing temperature so that a certain fixing ratio may be guaranteed. The words "secure fixing temperature" refer to a lower limit at temperatures above which a toner image can be satisfactorily fixed. Generally, when a fixing unit is operated in a continuous copy mode, heat is absorbed by papers which are sequentially fed to the unit with the result that the fixing temperature is lowered. In such a condition, power has to be supplied to the fixing roller. A problem which arises here is that when the power which can be supplied is limited as is the case with a power supply for family use, a continuous copy mode operation or the like is apt to reduce the power available to such an extent that the temperature of the fixing roller becomes lower than the secure fixing temperature. This frequently occurs particularly in a high-speed electrophotographic copier. It has been customary to cope with the drop of the fixing roller temperature beyond the secure fixing temperature by interrupting the copying operation or reducing the copying rate, i.e., by reducing the heat which is absorbed by papers to restore the fixing roller temperature to the secure fixing level. This kind of scheme is undesirable because both the interruption of operation and the reduction of copying rate lower the copying efficiency.

In the light of this, Japanese Laid-Open Patent Publication No. 55-74573, for example, discloses a method which detects a difference in fixing ratio between the time at which a warm-up period of the fixing unit expires and the time to follow. This scheme, however, is not fully satisfactory.

SUMMARY OF THE INVENTION

It is therefore an object of the present invention to eliminate the drawbacks particular to the prior art methods as discussed above.

It is another object of the present invention to provide a method of controlling a fixing unit which allows a minimum of interruption of copying operation and reduction of copying rate to occur even when the power which can be supplied to the fixing unit is limited.

It is another object of the present invention to provide a generally improved method of controlling a fixing unit of an image forming apparatus.

In accordance with the present invention, in a method of controlling a fixing unit which is installed in a copier and includes a fixing roller and a pressing roller, at least two temperatures are selectively established as a secure fixing temperature of the fixing unit.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
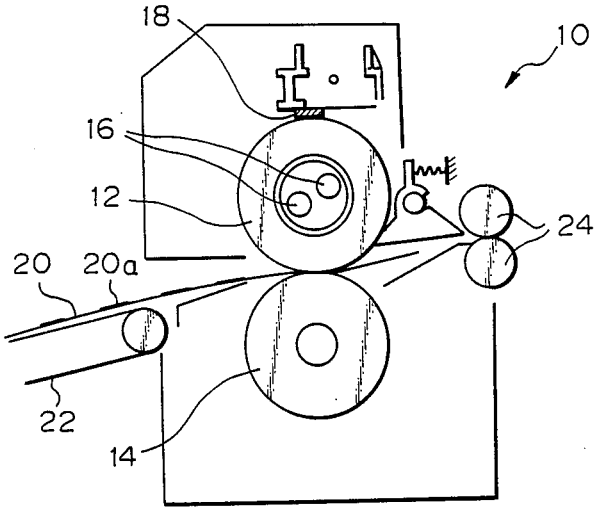
FIG. 1 is a sectional side elevation of a heat roller type fixing unit installed in an electrophotographic copier or the like to which the present invention is applicable.

Referring to FIG. 1 of the drawings, a fixing unit of an electrophotographic copier or the like to which the present invention is applicable is shown and generally designated by the reference number 10. As shown, the fixing unit 10 is constituted by a fixing roller 12 and a pressing roller 14. A heater 16 is accommodated in the fixing roller 12. A thermistor 18 is provided for sensing the temperature of the fixing roller 12. A paper 20 carrying a toner image **20*a* thereon is fed to a nipping section of the rollers 12 and 14, whereby the toner image 20*a* is fixed on the paper 20. In FIG. 1, the reference numerals 22 and 24** designate a transport belt and a discharge roller pair, respectively.

It has been customary to select a secure fixing temperature, which in this case insures good fixing of the toner image **20*a* on the paper 20, on the basis of the kind of a paper, the density of an original document, and the method of deciding a fixing ratio. However, the fixing ratio is susceptible to the conditions of a machine (copier) and ambient conditions also. Specifically, although the temperature of the fixing roller 12 may be maintained constant, the temperature of the pressing roller 14, the temperature of the entire unit 10 and the temperature of the paper 20 are not constant. As for the conditions of the machine, the fixing ratio achievable is lowest when the power supply of the copier is turned on for the first time while the copier temperature is low such as in the morning and then operated immediately after a warm-up period. An acceptable fixing ratio is attainable only when a waiting time which follows the warm-up period expires, i.e., when a predetermined period of time expires after the heater 16** has been operated to provide a temperature high enough for the copier to operate immediately and when a certain number of copies are produced after the warm-up period. Such a relationship between the copier temperature and the fixing ratio is shown in FIG. 2.

Figure 2:
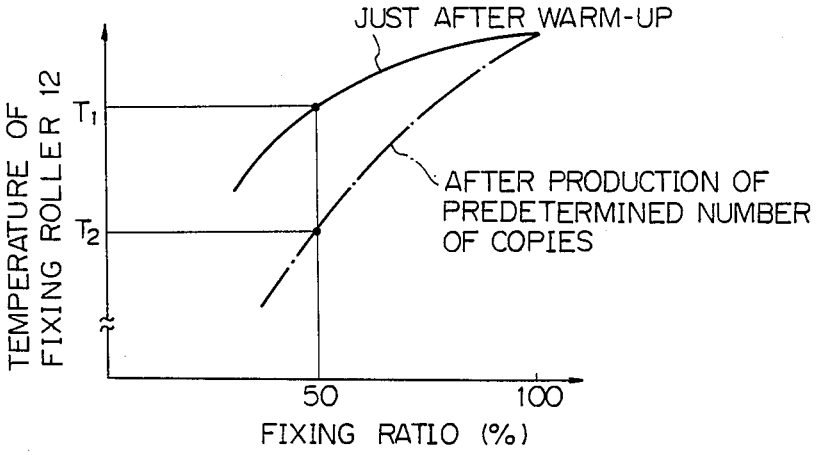
FIG. 2 is a plot showing a relationship between the temperature of a fixing roller of FIG. 1 and the fixing ratio.

In FIG. 2, the ordinate is representative of the temperature of the fixing roller 12 while the abscissa is representative of the fixing ratio in terms of percentage. A solid curve of FIG. 2 shows a relationship between the temperature of the fixing roller 12 and the fixing ratio which holds immediately after a warm-up period, and a dash-and-dot curve shows a relationship between them which holds when a predetermined number of copies have been produced after a warm-up period. As shown, the same fixing ratio is not achievable unless the temperature of the fixing heater 12 is higher for a copying operation which occurs immediately after a warm-up period than for a copying operation which occurs upon the lapse of an extra period of time that follows a warm-up period. Assume that the secure fixing temperature corresponds to a fixing ratio of 50% by way of example. Then, while the fixing roller 12 has to be heated to a temperature of $T_1$ for an operation which occurs immediately after a warm-up period, it only needs to be heated to a temperature of $T_2$ which is lower than the temperature $T_1$ for an operation which occurs upon the lapse of an extra period of time. Heretofore, the temperature $T_1$ has been selected as the secure fixing temperature in order to guarantee predetermined image quality, i.e., to secure the fixing ratio even for an operation which occurs immediately after a warm-up period. Such a high secure fixing temperature gives rise to a problem that the temperature of the fixing roller 12 is apt to be lowered during, for example, a continuous copy mode operation resulting in the interruption of the operation and other undesirable occurrences, as discussed earlier.

In accordance with the present invention, the problem stated above is eliminated by changing the secure fixing temperature depending upon the conditions. Specifically, the secure fixing temperature immediately after a warm-up period which may be $T_1$ is changed to $T_2$ when a predetermined condition which will be described is reached. To find out the particular condition, the temperature of the pressing roller 14 which is the most critical cause of the difference between the temperatures $T_1$ and $T_2$ was examined. The result of examination is shown in FIGS. 3 and 4.

Figure 3:
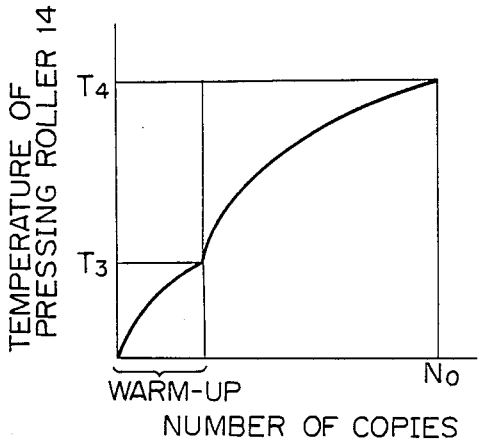
FIG. 3 is a plot showing a relationship between the number of copies which are continuously produced after a warm-up period of a fixing unit and the temperature of a pressing roller.
Figure 4:
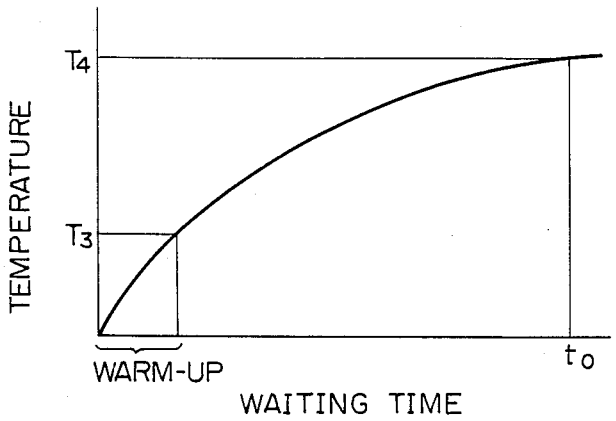
FIG. 4 is a plot showing a relationship between a waiting time after a warm-up period of a fixing unit and the temperature of a pressing roller.

FIG. 3 shows a relationship between the temperature of the pressing roller 14 and the number of copies produced which was determined by producing a plurality of copies immediately after a warm-up period. As shown, the pressing roller 14 is heated to a temperature $T_4$ after it has been heated to a temperature $T_3$ by a warm-up operation and then $N_0$ copies have been produced. On the other hand, FIG. 4 shows a relationship between the waiting time which follows a warm-up period and the temperature of the pressing roller 14. It will be understood that the temperature of the pressing roller 14 reaches a saturation level $T_4$ at a time $t_0$ after the power supply has been turned on. Further, the temperature of the fixing roller 12 which guarantees the fixing ratio of 50% is $T_1$ when the temperature of the pressing roller 14 is $T_3$ and $T_2$ when it is $T_4$.

In accordance with the present invention, the secure fixing temperature is changed with $N_0$ copies are produced after a warm-up or when the period of time $t_0$ expires after the turn-on of the power supply. Specific examples of such a procedure are shown in FIGS. 5A to 5C, 6A to 6C, and 7A to 7C.

Figure 5A:
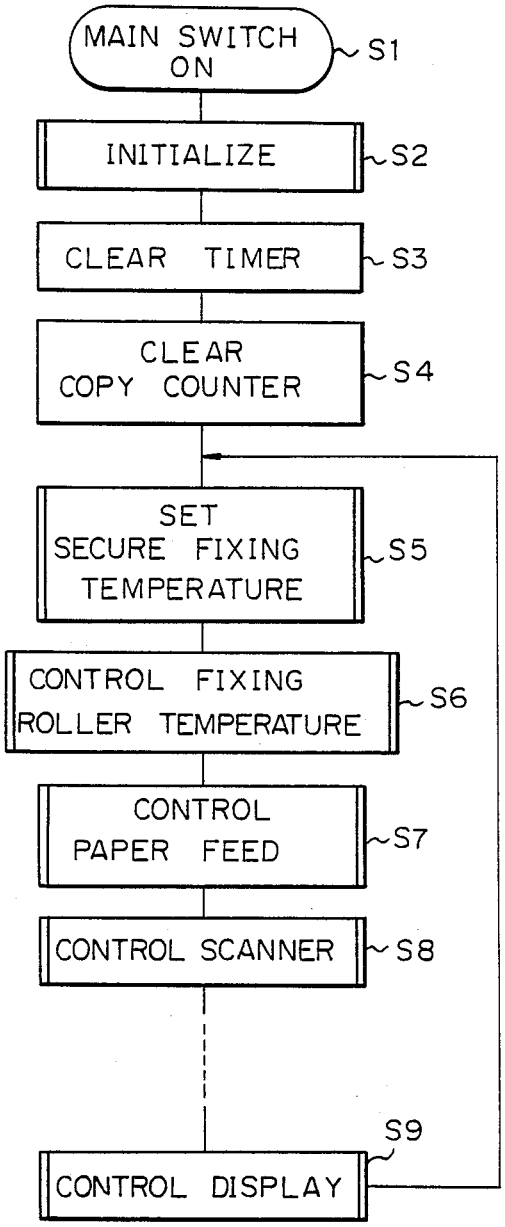
FIGS. 5A to 5C, 6A to 6C and 7A to 7C are flowcharts demonstrating some specific control procedures in accordance with the present invention.
Figure 5B:
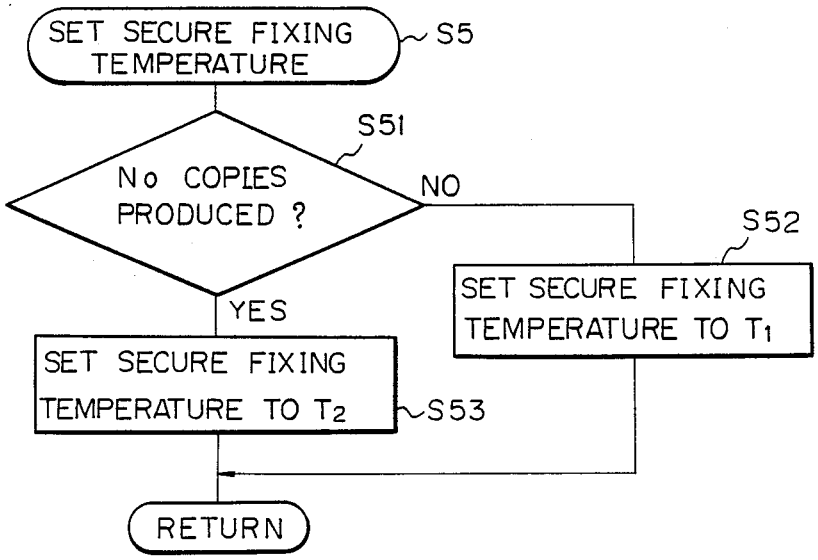
Figure 5C:
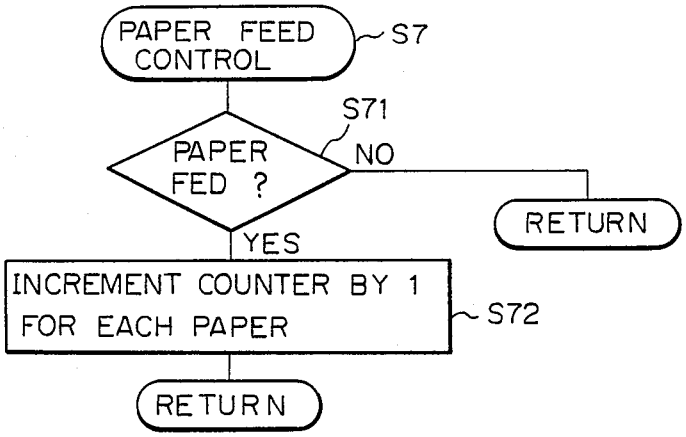

FIGS. 5A to 5C are flowcharts demonstrating a specific procedure in which the temperature $T_2$ is selected to be the secure fixing temperature until $N_0$ copies have been produced after the turn-on of the power supply and thereafter replaced with the temperature $T_2$. FIG. 5A shows a general routine of the copier. As shown, when a main switch of the copier is turned on (S1), the copier is initialized (S2), a timer is cleared (S3), and a copy counter is cleared (S4). This is followed by a sequence of steps for setting a secure fixing temperature, shown in FIG. 5B. In a step S51 of FIG. 5B, whether $N_0$ copies have been produced after the turn-on of the main switch is determined. If the actual number of copies produced is smaller than $N_0$, the secure fixing temperature is set to $T_1$ (S52). If $N_0$ or more copies have been produced, the secure fixing temperature is set to $T_2$ (S53). In this manner, the temperature of the fixing roller 12 is controlled (S6) and then the feed of papers is controlled (S7) as shown in FIG. 5C in detail. In FIG. 5C, whether a paper has been fed is determined paper by paper (S71) and, if a paper has been fed, the copy counter is incremented by 1 (S72). In steps S8 and S9 of the general routine, a scanner and a display are respectively controller.

Figure 6A:
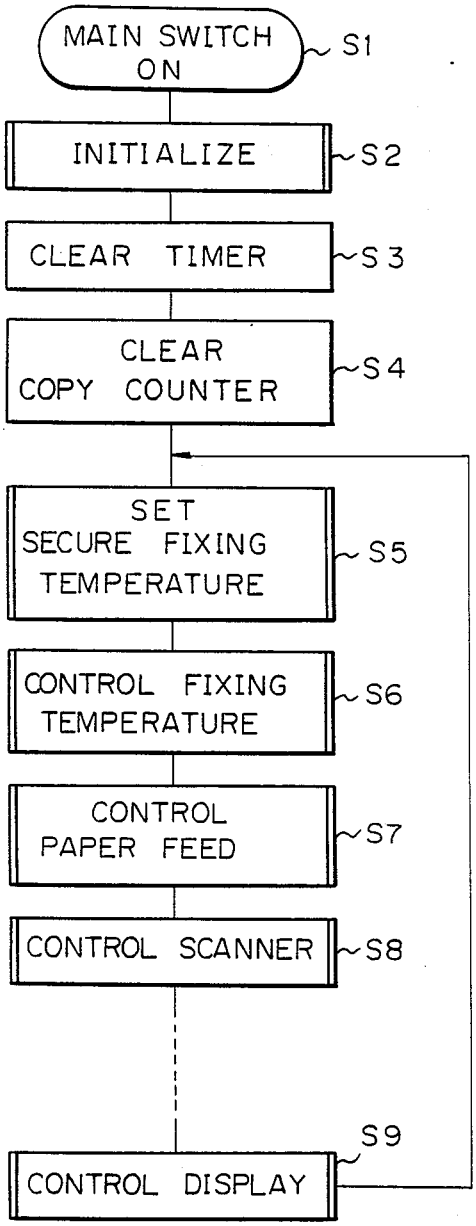
Figure 6B:
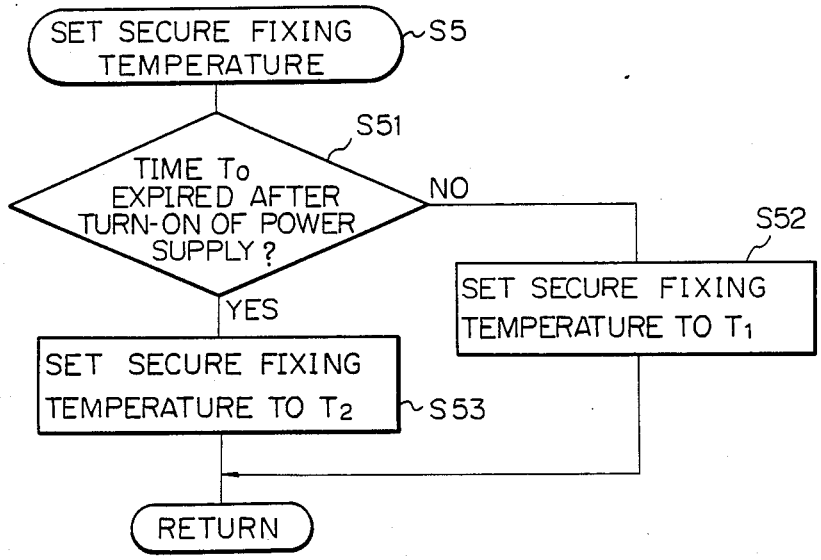
Figure 6C:
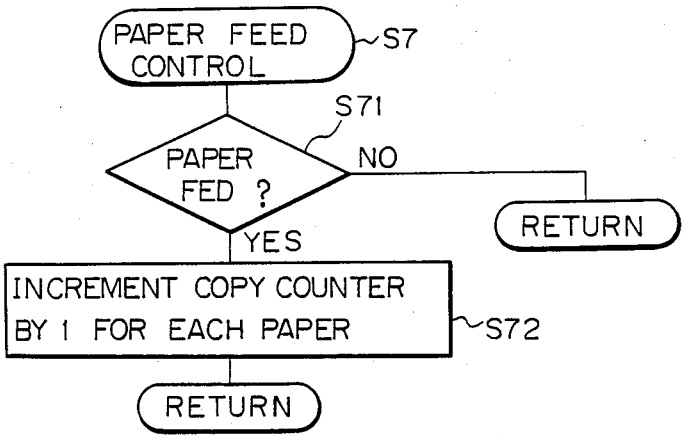
Figure 7A:
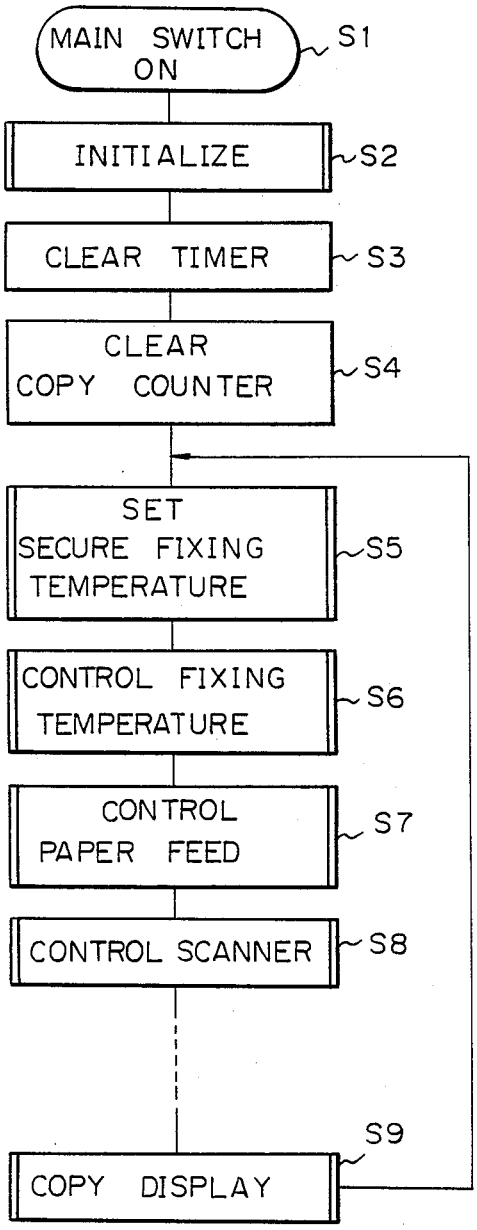
Figure 7B:
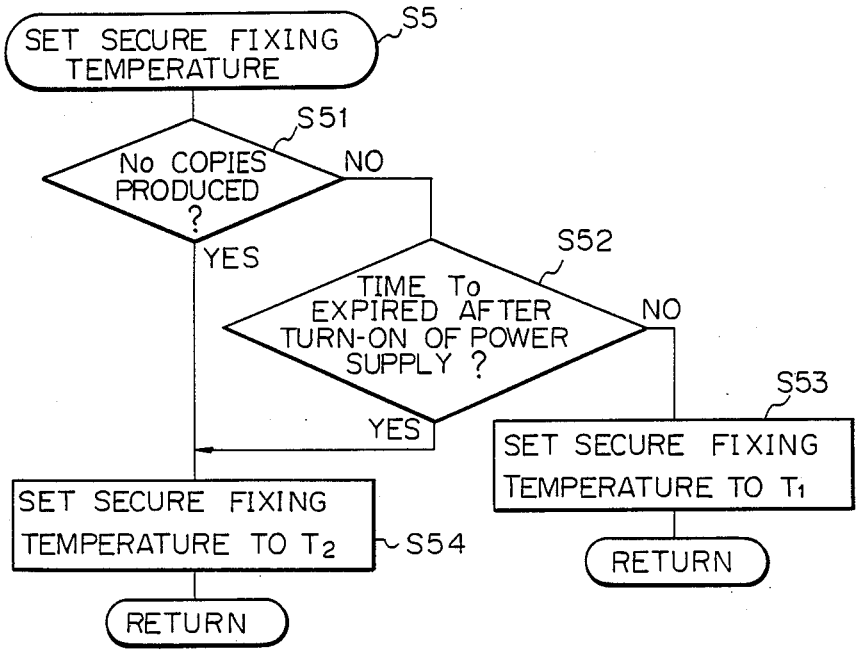
Figure 7C:
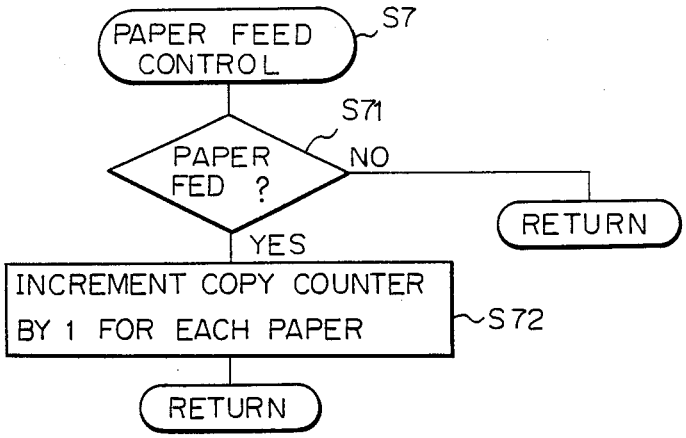

FIGS. 6A to 6C demonstrate a specific procedure in which the temperature $T_1$ is selected to be the secure fixing temperature until the period of time $t_0$ expires after the turn-on of the power supply and thereafter replaced with the temperature $T_2$. FIGS. 7A to 7C show another specific procedure in which the temperature $T_1$ is selected to be the secure fixing temperature until one of the end of production of $N_0$ copies and the expiration of the period of time $t_0$ which occurs earlier than the other and thereafter replaced with the temperature $T_2$. Details of these procedures will be readily understood by analogy from the description of FIGS. 5A to 5C and therefore will not be described to avoid redundancy.

In summary, it will be seen that the present invention is successful in setting up an adequate secure fixing temperature to thereby allow a minimum of wasteful interruption of copying operation and the like to occur while guaranteeing an acceptable fixing ratio.

Various modifications will become possible for those skilled in the art after receiving the teachings of the present disclosure without departing the scope thereof.

What is claimed is:

1. In a method of controlling a fixed unit which is installed in a copier which includes a fixing roller and a pressing roller and in which copier said fixing unit is operated to fix a toner image on a sheet of copy paper when the fixing roller is at a secure fixing temperature defined as a lower limit at temperatures above which the toner image can be satisfactorily fixed, the improvement comprising:

selectively establishing at least two temperatures as secure fixing temperatures of the fixing unit in dependence on at least one predetermined condition.

2. A method as claimed in claim 1, wherein the secure fixing temperature differs from a time when at least one of a condition that more than a predetermined number of copies have been produced and a condition that a predetermined period of time has not expired after turn-on of a power supply is satisfied to a time when none of said two conditions have been satisfied.

3. A method of controlling a fixing unit which is installed in a copier and constituted by a fixing roller and a pressing roller and in which copier said fixing unit is operated to fix a toner image on a sheet of copy paper when the fixing roller is at a secure fixing temperature defined as a lower limit at temperatures above which the toner image can be satisfactorily fixed, comprising the steps of:

(a) turning on a power supply;

(b) setting the secure fixing temperature to a first temperature; and (c) changing the secure fixing temperature to a second temperature when a predetermined condition is reached after the turn-on of the power supply.

4. A method as claimed in claim 3, wherein the predetermined condition is that a predetermined number of copies have been produced after the turn-on of the power supply.

5. A method as claimed in claim 3, wherein the predetermined condition is that a predetermined period of time has expired after the turn-on of the power supply.

6. A method as claimed in claim 3, wherein the predetermined condition is at least one of that a predetermined number of copies have been produced after the turn-on of the power supply and that a predetermined period of time has expired after the turn-on of the power supply.

* * * * *